US012478177B2

(12) United States Patent
Uffmann et al.

(10) Patent No.: US 12,478,177 B2
(45) Date of Patent: Nov. 25, 2025

(54) PIVOT AND PULL-OUT FITTING FOR A CORNER CABINET

(71) Applicant: Ninkaplast GmbH, Bad Salzuflen (DE)

(72) Inventors: Axel Uffmann, Melle (DE); Johann Wiens, Bad Oeynhausen (DE)

(73) Assignee: Ninkaplast GmbH, Bad Salzuflen (DE)

( * ) Notice: Subject to any disclaimer, the term of this patent is extended or adjusted under 35 U.S.C. 154(b) by 46 days.

(21) Appl. No.: 18/683,409

(22) PCT Filed: Jul. 21, 2022

(86) PCT No.: PCT/EP2022/070446
§ 371 (c)(1),
(2) Date: Feb. 13, 2024

(87) PCT Pub. No.: WO2023/036505
PCT Pub. Date: Mar. 16, 2023

(65) Prior Publication Data

US 2024/0349892 A1 Oct. 24, 2024

(30) Foreign Application Priority Data

Sep. 10, 2021 (DE) ..... 20 2021 104 888.3

(51) Int. Cl.
*A47B 81/00* (2006.01)

(52) U.S. Cl.
CPC ..... *A47B 81/002* (2013.01)

(58) Field of Classification Search
CPC ... A47B 81/002; A47B 49/004; A47B 49/006; A47B 57/08; A47B 57/10; A47B 57/26;
(Continued)

(56) References Cited

U.S. PATENT DOCUMENTS 277,510 A * 5/1883 Roberts ..... A47B 57/26 108/106
309,360 A * 12/1884 Roberts ..... A47B 57/26 108/106

(Continued)

FOREIGN PATENT DOCUMENTS

DE 7135889 U 12/1971
DE 4319288 A1 12/1994

(Continued)

OTHER PUBLICATIONS

Sperrklinke, In: Wikipedia, Die freie Enzyklopädie, Bearbeitungsstand: Dec. 8, 2020, 08:50 UTC, at url: https://de.wikipedia.org/w/index.php?title=Sperrklinke&oldid=206338118 (see https://de.wikipedia.org/wiki/Sperrklinke).

*Primary Examiner* — Andrew Roersma
(74) *Attorney, Agent, or Firm* — Richard M. Goldberg

(57) ABSTRACT

A pivot and pull-out fitting for a shelf (20) in a corner cabinet (10), includes a carrier (24) held rotatably about a vertical axis (26) in the corner cabinet; a pivot bearing for pivotably mounting the shelf on the carrier; and a pull-out guide, on which the shelf can be displaced relative to the carrier, wherein carrier (24) is mounted pivotably on a bracket (28) that is guided in a rotationally fixed and axially displaceable manner on an axial tube (29) rigidly installed in the corner cabinet and can be secured in a self-locking manner on the axial tube by a clamping lever (56).

6 Claims, 7 Drawing Sheets

(58) Field of Classification Search
CPC ..... A47B 57/265; A47B 57/32; A47B 57/34; A47B 57/54; A47B 57/545
See application file for complete search history.

(56) References Cited

U.S. PATENT DOCUMENTS

| | | | | | |
|---|---|---|---|---|---|
| 3,472,476 | A * | 10/1969 | Johnson | A47B 57/562 | 248/245 |
| 6,074,143 | A * | 6/2000 | Langston | B60P 1/00 | 410/148 |
| 7,267,310 | B2 * | 9/2007 | Welch | A47B 57/265 | 248/245 |
| 8,226,184 | B2 * | 7/2012 | Kang | A47B 57/06 | 312/319.1 |
| 9,103,362 | B2 * | 8/2015 | Baro | A47B 49/006 | |
| 10,092,094 | B2 * | 10/2018 | Sagel | A47B 49/006 | |
| 11,725,872 | B2 * | 8/2023 | Jin | F25D 25/02 | 312/408 |
| 2004/0060486 | A1 | 4/2004 | Franze et al. | | |
| 2007/0017887 | A1 * | 1/2007 | Rapier, III | A47B 49/006 | 211/166 |
| 2019/0174967 | A1 | 6/2019 | Worden, IV et al. | | |

FOREIGN PATENT DOCUMENTS

| | | | | |
|---|---|---|---|---|
| DE | 202009007374 | U1 | 10/2009 | |
| DE | 202010014345 | U1 * | 12/2010 | A47B 49/006 |
| DE | 202014103097 | U1 * | 10/2015 | A47B 49/006 |
| DE | 202014104994 | U1 * | 1/2016 | A47B 49/006 |
| DE | 202014105001 | U1 * | 1/2016 | A47B 49/00 |
| DE | 202015101212 | U1 * | 6/2016 | F16B 7/0486 |
| DE | 202016004737 | U1 * | 11/2017 | A47B 88/47 |
| EP | 2191745 | A1 * | 6/2010 | A47B 81/002 |
| EP | 2253244 | A1 | 11/2010 | |
| EP | 2353441 | A1 * | 8/2011 | A47B 49/006 |
| EP | 3403528 | A1 | 11/2018 | |
| EP | 3569874 | A1 * | 11/2019 | F16M 11/22 |
| NL | 2005731 | C | 5/2012 | |
| WO | 2008/062965 | A1 | 5/2008 | |

* cited by examiner

PIVOT AND PULL-OUT FITTING FOR A CORNER CABINET

BACKGROUND OF THE INVENTION

The invention relates to a pivot and pull-out fitting for a shelf in a corner cabinet, comprising a carrier that is held rotatably about a vertical axis in the corner cabinet; a pivot bearing for pivotably mounting the shelf on the carrier; and a pull-out guide on which the shelf can be displaced relative to the carrier.

A pull-out fitting of this type has been described in EP 2 253 244 B1. The fitting is particularly provided for kitchen corner cabinets, wherein only one half of the front is accessible via a door whereas the other half of the front is blocked by another furniture body. There, the pull-out guide is mounted on an intermediate carrier that is supported on the carrier by means of the pivot bearing. When the shelf is to be pulled out, the entire assembly comprising the carrier, the intermediate carrier, and the shelf is at first pivoted about the axis of the carrier. After an initial phase of this movement, a coupling mechanism enforces an additional rotation of the intermediate carrier relative to the carrier by means of a positive guide acting between the cabinet body and the intermediate carrier. In the end phase of the movement, the shelf can be pulled out relative to the intermediate carrier through the door opening. The shelf is guided not only relative to the intermediate carrier but also relative to the carrier such that it can be brought into a position in which it projects relatively far from the door opening and is therefore readily accessible, and the shelf may have a usable area as large as possible and efficiently utilizes the available space in the corner cabinet without colliding with the body of the corner cabinet during the pivot and pull-out movement.

In the drawn-out position of the shelf, the intermediate carrier and the carrier are locked such that, when the shelf is pushed back into the cabinet corpus, at first only a linear movement of the shelf is permitted before the pivotal movements of the intermediate carrier and the carrier sets in again.

Frequently, two shelves are arranged in this way at different heights in the same corner cabinet. The lower one of these shelves is located directly above the bottom of the corner cabinet corpus so that the internal space of the corner cabinet may be utilized effectively. The other shelf is arranged approximately at half the height of the corner cabinet by means of another fitting that has the design described above.

SUMMARY OF THE INVENTION

It is an object of the invention to allow for an easy height adjustment of the upper shelf.

In order to achieve this object, according to the invention, the carrier is mounted pivotably on a bracket that is guided in a rotationally fixed and axially displaceable manner on an axle tube that is rigidly installed in the corner cabinet, and can be secured in a self-locking manner on the axle tube by means of a clamping lever.

When the clamping lever is unlocked by hand, the bracket can be slid on the axle tube into the desired height. Since the entire assembly of the carrier and the shelf is held on the bracket, a height adjustment of the shelf is made possible. When the clamping lever is in its clamping position, it engages the axle tube with a clamping contour, so that the bracket and therewith also the carrier and the shelf are clampingly held on the axle tube. Due to the weight of the carrier, the shelf, and the objects deposited thereon, the clamping lever is subject to a torque that has the tendency to tilt the clamping leaver further in the direction towards its clamping position, so that the clamping force is increased and the entire fitting is self-lockingly held in position.

Useful details and further developments of the invention are indicated in the dependent claims.

In a useful embodiment, the clamping lever is supported at the bottom side of the bracket so as to be pivotable about a horizontal axis, and one end of the clamping leaver forms the clamping contour that engages the axle tube in the clamping position.

The axle tube is preferably a square tube that forms a large surface of attack for a straight clamping contour of the clamping lever.

The opposite end of the clamping lever preferably projects beyond the edge of the bracket so that this end can readily be gripped by hand in order to unlock the clamping mechanism by pulling this end of the clamping lever upwards and thereby pivoting the clamping contour away from the axle tube.

The clamping lever may be elastically biased into the clamping position by means of a spring so that the clamped state is established automatically as soon as the user releases the clamping lever.

BRIEF DESCRIPTION OF THE DRAWINGS

An embodiment example are now described in conjunction with the drawing, wherein.

DETAILED DESCRIPTION

Figure 1:
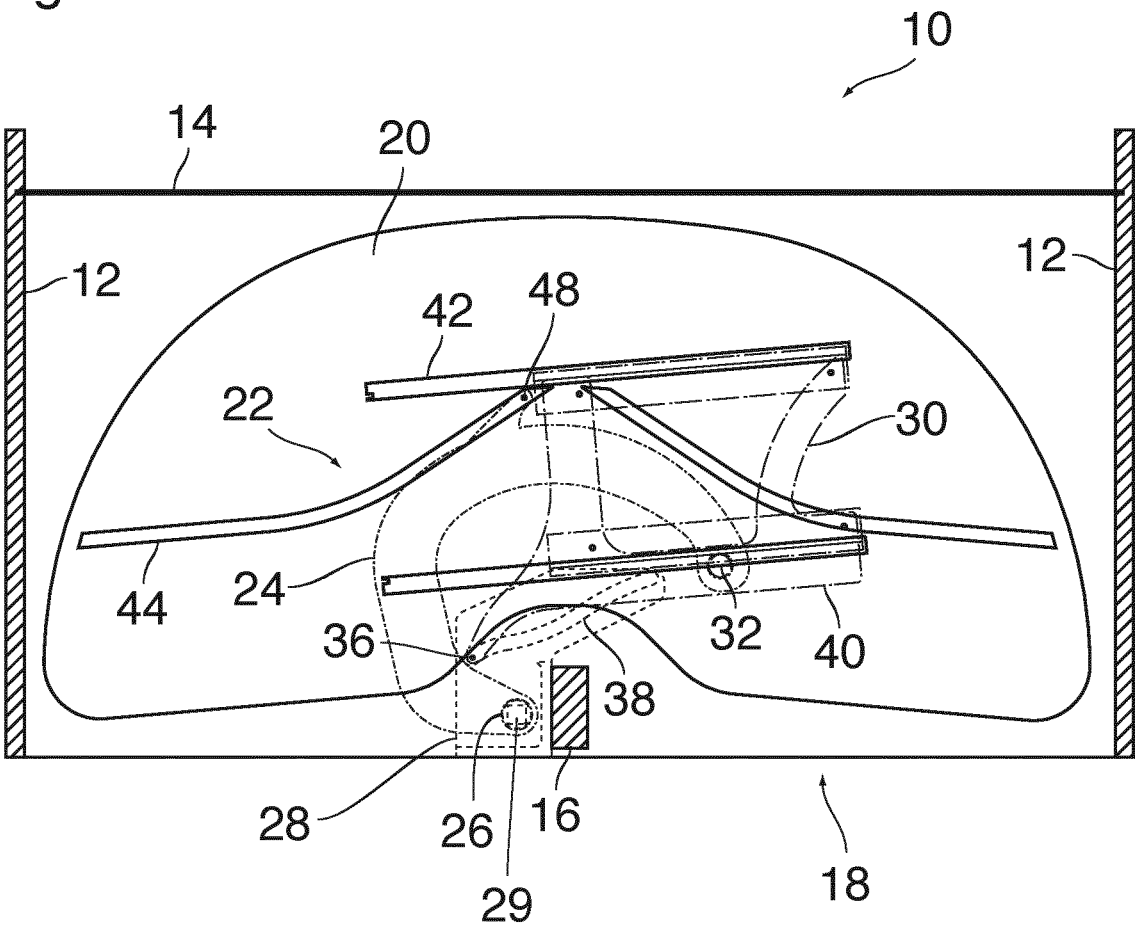
FIG. 1 is schematic plan view of a cabinet body having a shelf and a fitting as known from EP 2 253 244 B1.

FIG. 1 shows a horizontal cross-section of a body of a kitchen corner cabinet 10 having side walls 12, a rear wall 14 and a center post 16 which defines, together with the right side wall 12, a door opening 18, whereas the left half of the front of the cabinet is blocked by another furniture body which has not been shown. An approximately semi-circular shelf 20 is accommodated inside the cabinet. By means of a fitting 22 of which only the contour has been shown in phantom lines, the shelf 20 is held in the cabinet in such a way that it can be pivoted out of the door opening 18 and can then be pulled-out further.

The fitting 22 comprises a rigid, arcuate carrier 24 that is pivotable about a vertical axis 26 that is stationary relative to the cabinet body. The axis 22 is arranged on the side of the center post 16 facing away from the door opening and is rotatably supported in a bracket 28 that is rigidly mounted to the cabinet body.

Figure 2:
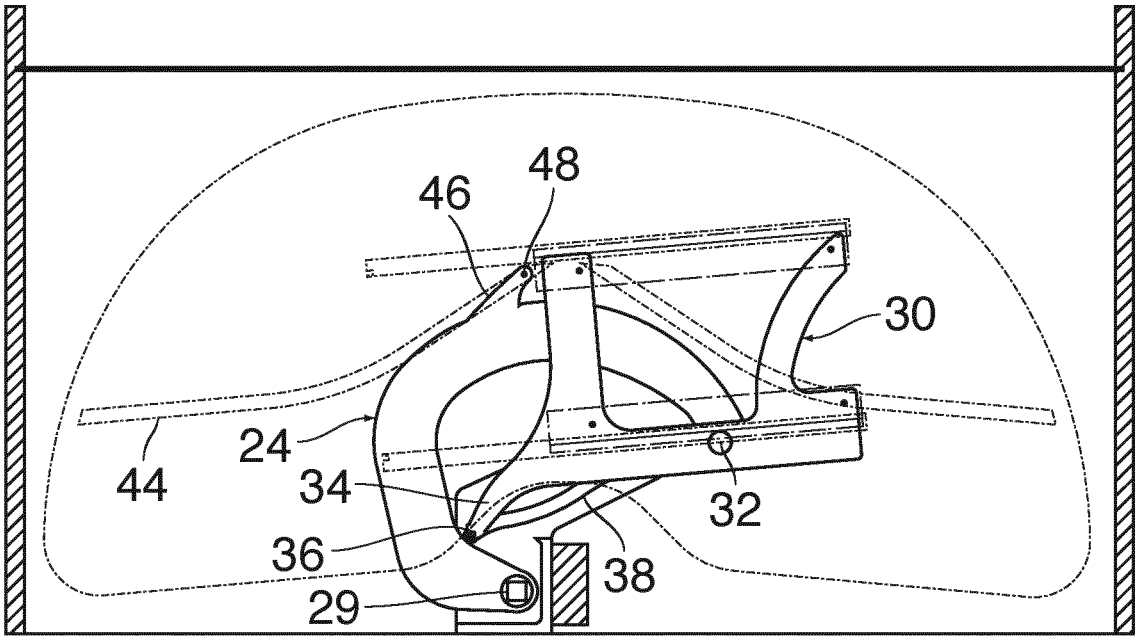
FIG. 2 is the same plan view as FIG. 1, but with different component parts of the fitting being highlighted.

As can be seen more clearly in FIG. 2, an intermediate carrier 30 is supported on the distal end of the carrier 24 and is pivotable relative to the carrier 24 about another vertical axis 32. On the side that is closer to the center post, the intermediate carrier 30 has an arm 34 which carriers a guided member 36 at its free end. The guided member engages in a guide slot 38 formed in a cantilever of the bracket 28.

Moreover, the intermediate carrier 30 carries on its top side a pair of parallel guide rails 40 (shown in dot-dashed lines in the drawing), which co-operate with runners 42 arranged on the bottom side of the shelf 20.

Moreover, two arcuate guide slots 44 are formed in a mirror-image configuration in the bottom side of the shelf 20, and only the left one of these guide slots is used in the given example. The other guide slot is provided for use of the shelf in a cabinet body having the door opening 18 on the opposite side. The guide slots 44 may for example be formed directly in the shelf when the latter is molded from plastics.

As can be seen most clearly in FIG. 2, an arm 46 projects from the carrier 24 and is formed at its free end with a guided member 48 engaged in the guide slot 44 of the shelf.

In the condition shown in FIG. 1, the intermediate carrier 30 is locked by the guided member 36 and the guide slot 38 against rotation relative to the carrier 24, so that the carrier and the intermediate carrier behave like a rigid unit. Further, the shelf 20 is locked against displacement along the runners 42 because the part of the guide slot 44 accommodating the guided member 48 is inclined relative to the runners 42.

When, now, the user wants to rotate the shelf 20 out of the door opening, he clasps with his hand the edge of the shelf through the door opening and pulls the shelf forward. As a result, the shelf 20 and the fitting 22 rotate as a rigid unit about the axis 26. As can be seen in FIG. 1, the leftmost terminal portion of the guide slot 38 is shaped as a circular arc around the axis 26, so that, in the course of the rotation, the guided member 36 may move in the guide slot 38 while continuing to block the intermediate carrier 30 against rotation relative to the carrier 24.

Figure 3:
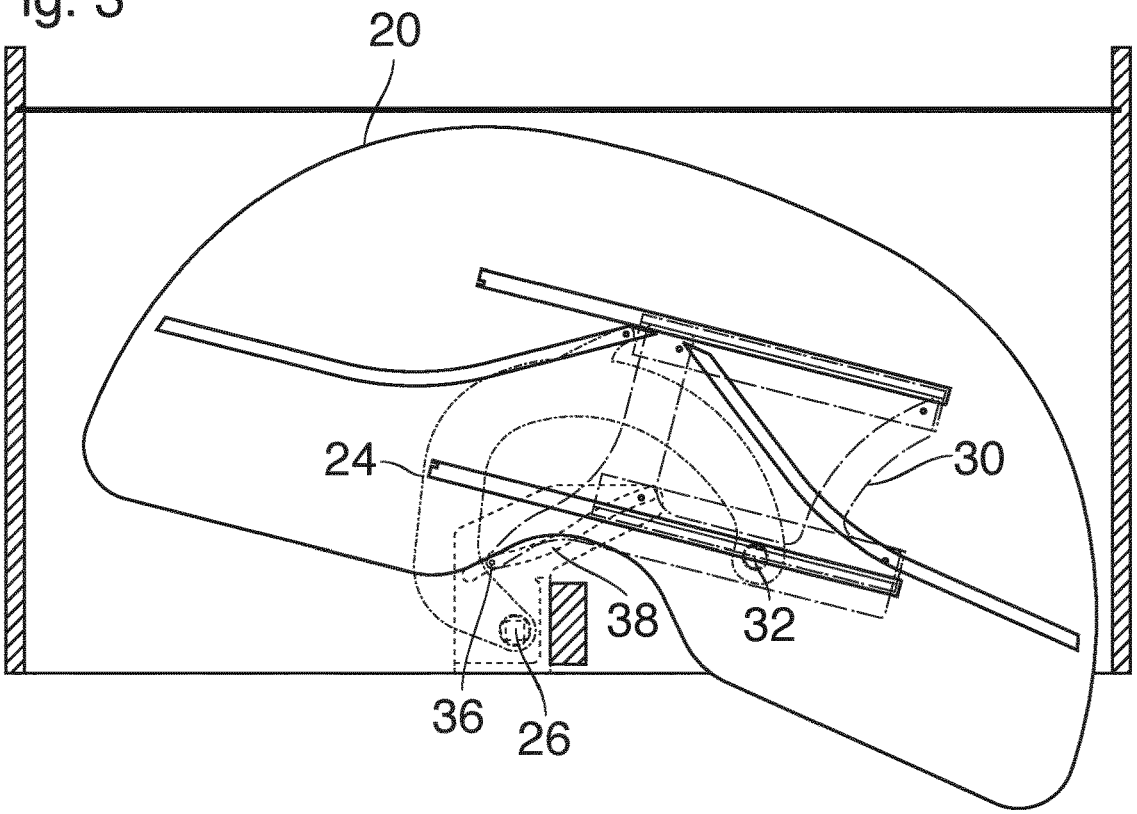
FIGS. 3 and 4 the state of the fitting after an initial phase of a pivotal movement.
Figure 4:
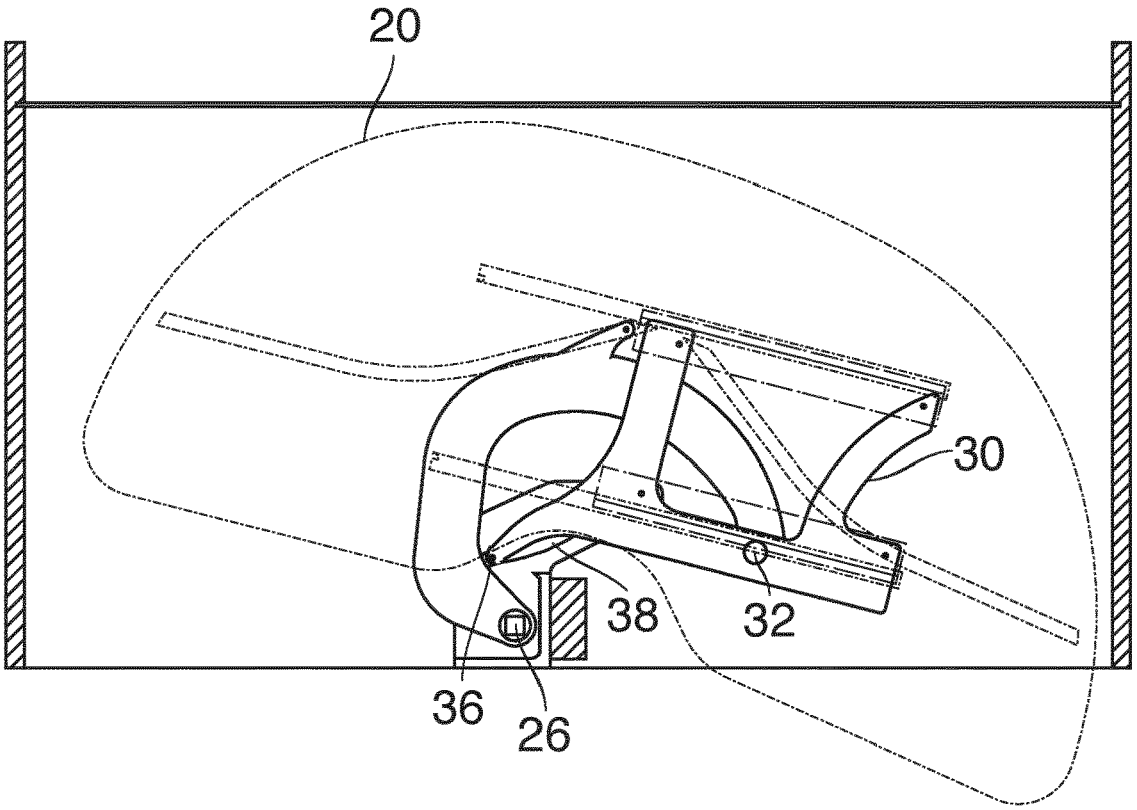

Only when the condition shown in FIGS. 3 and 4 has been reached, the guided member 36 enters into a portion of the guide slot 38 which gradually retreats from the axis 26. Consequently, an additional pivotal movement of the intermediate carrier 30 and the shelf 20 about the axis 32 is enforced in the further course of the rotation of the carrier.

Figure 5:
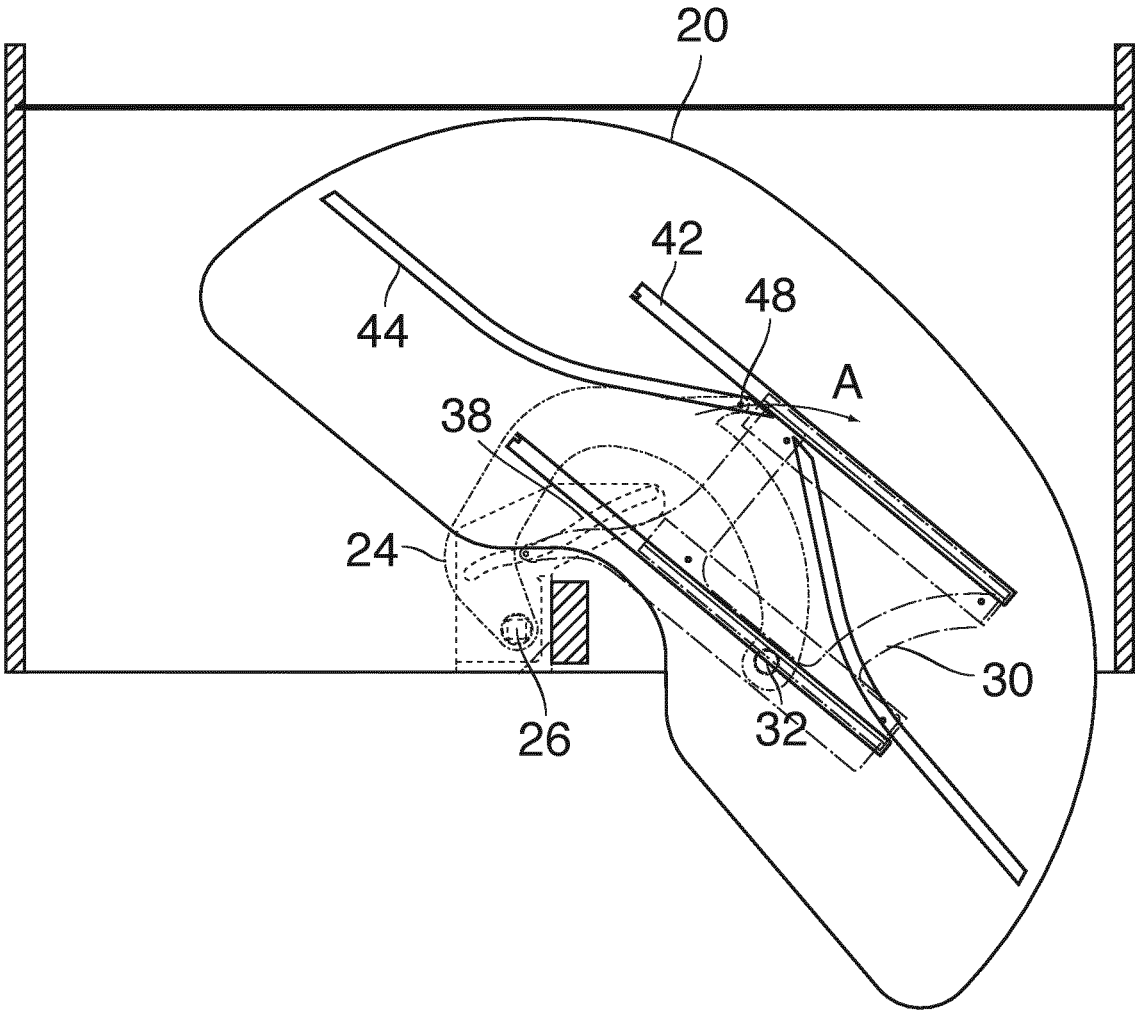
FIG. 5 the state of the fitting in the further course of the pivotal movement.

FIG. 5 shows a somewhat later stage of the motion sequence. The carrier 24 has been pivoted clock-wise about the axis 26, and the intermediate carrier 30 has started with its pivotal movement about the axis 32, also in clock sense. As a result of this pivotal movement relative to the carrier 24, the lower edge of the guide slot 44 in FIG. 4 runs onto the guided member 48 that is rigidly held at the carrier 24, as has been symbolized by an arrow A in FIG. 5. The resulting force which the guided member 48 exerts onto the guide slot 44 is directed orthogonally to the guide slot and has a component in parallel with the runners 42 and thus enforces the start of the linear displacement of the shelf 20 along the guide rails. This displacement is assisted by the user pulling the shelf with his hand. In this way, the pivotal movement of the fitting is superposed by a pull-out movement of the shelf 20 that gradually sets-in.

Figure 6:
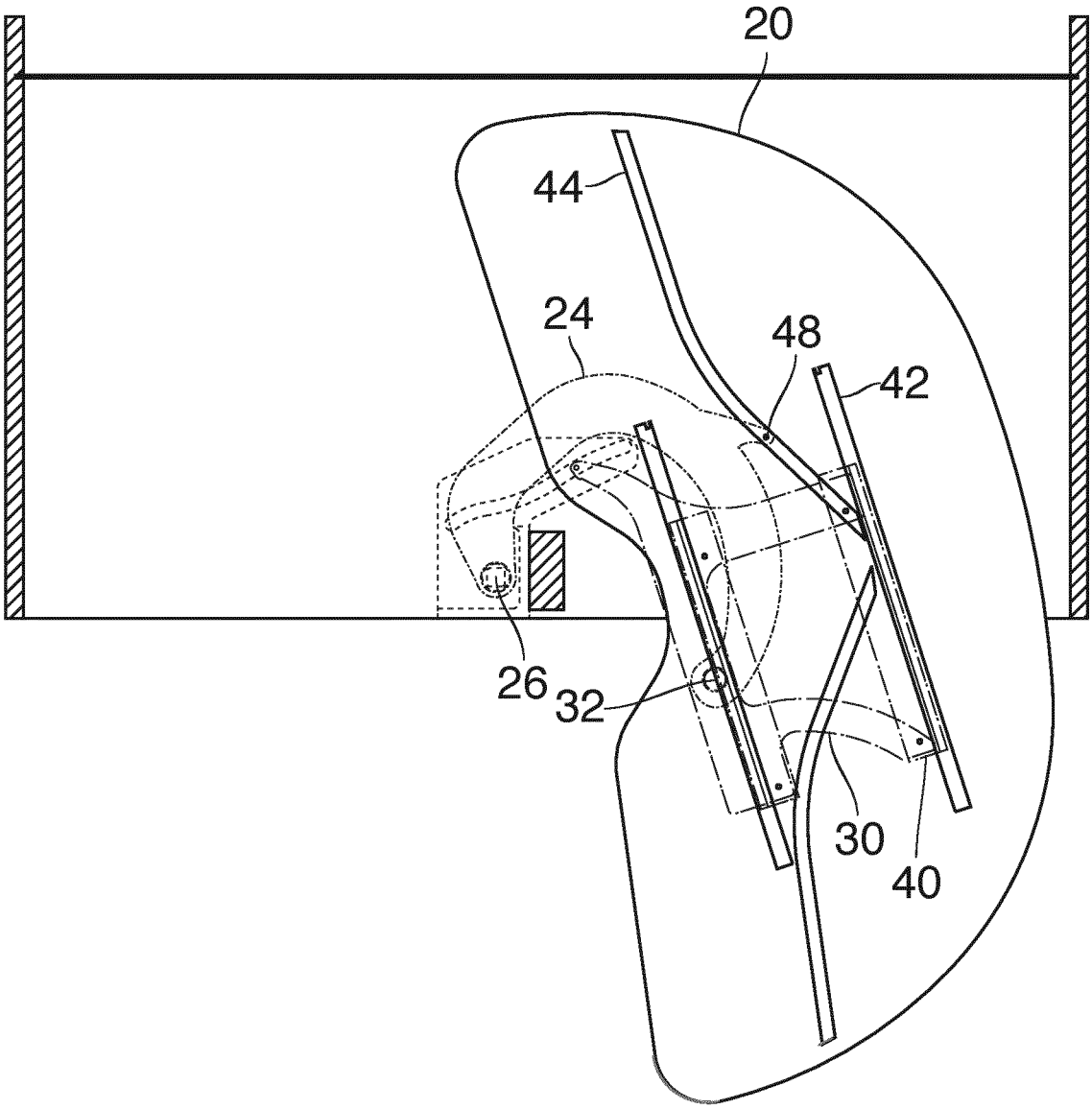
FIG. 6 the state of the fitting in the further course of the pivotal movement with simultaneous start of a linear pull-out movement of the shelf.

FIG. 6 shows yet a later stage of the motion sequence. The carrier 24 and the intermediate carrier 30 have continued their pivotal movements, and the guided member 48 has travelled a considerable distance in the inclined branch of the slot 44, so that the shelf 20 with its runners 42 has moved a corresponding distance along the guide rails 40.

Figure 7:
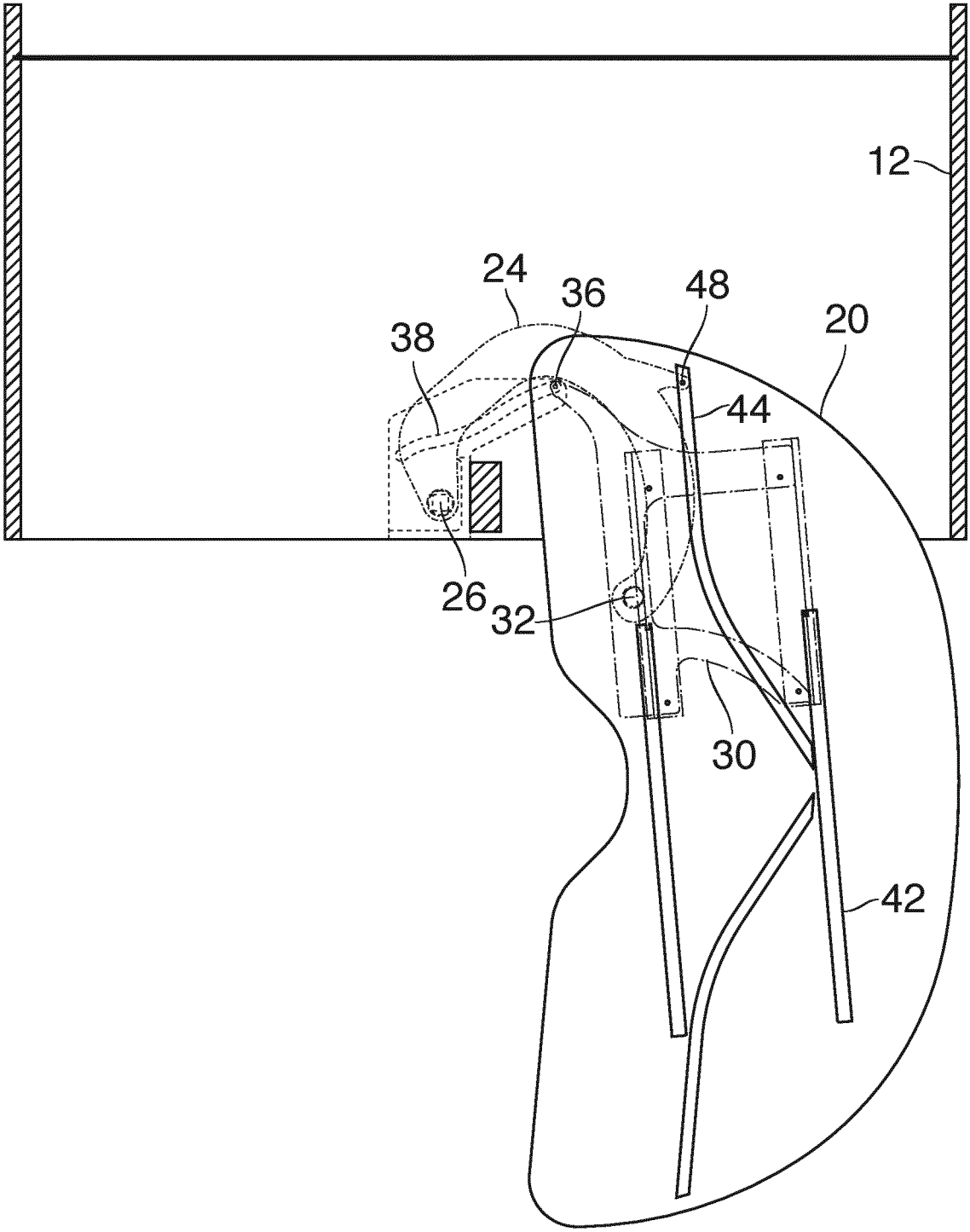
FIG. 7 the fitting with the shelf fully drawn-out.

In FIG. 7, the final stage of the movement has finally been reached. The carrier 24 has been rotated into its end position in which the end carrying the axis 32 is located already outside of the door opening. Since the intermediate carrier 30 and, eventually, the shelf 20 are supported by the carrier 24 at the location of the axis 32, the shelf can bear a high load even in the completely pulled-out position.

The guided member 36 has reached the end of the guide slot 38, so that the movement of the intermediate carrier 30 has stopped as well. The guided member 48 mounted on the carrier 24 has reached the end of the guide slot 44 after having passed through a straight portion of this guide slot that extends in parallel with the runners 42. In this phase, the only movement that has taken place was the linear displacement of the shelf relative to the intermediate carrier. As a result of the curved shape of the guide slot 44, the pivotal movement of the intermediate carrier relative to the carrier has been braked smoothly when the guided member 48 has travelled through the guide slot, and the superposed rotation and linear displacement has smoothly merged into a pure linear displacement. Moreover, in the position shown in FIG. 7, the carrier 24 cannot be pivoted about the axis 26, not even in counterclock sense in FIG. 7. As long as the guided member 48 is located in the straight branch of the guide slot 44 that extends in parallel with the runners 42, the intermediate carrier 30 cannot be pivoted relative to the carrier 24 about the axis 32, so that the carrier 24 and the intermediate carrier 30 behave again like a rigid unit. If one attempts to rotate this unit about the axis 26, then the guided member 36 mounted on the intermediate carrier would have to move on a circular trajectory about the axis 26. This, however, is prevented by the shape of the guide slot 38.

The same effect prevents the shelf 20 from abutting at the side wall 12 of the cabinet body when the shelf 20 is pushed back into the door opening. In the further course of the push-in and rotary movement, the forcibly guided movements that have been described above are performed in opposite sequence, until the condition shown in FIGS. 1 and 2 has been reached again.

Figure 8:
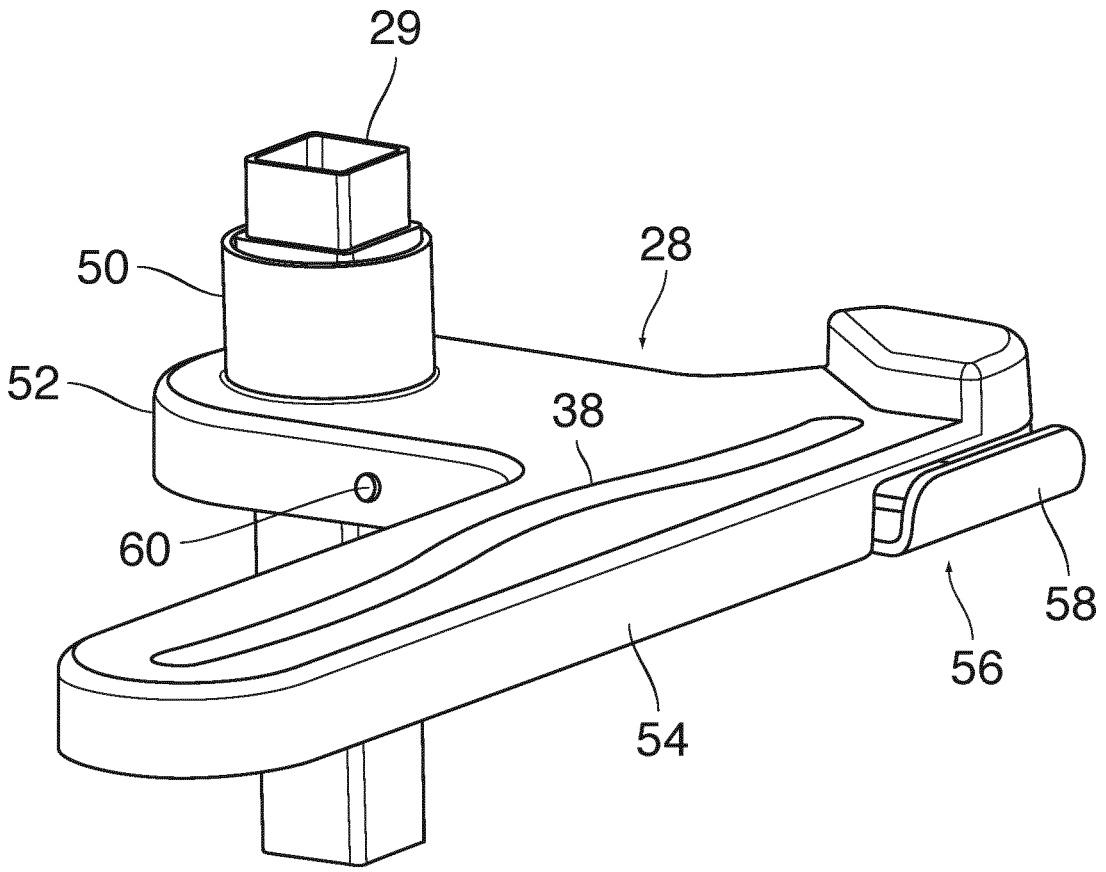
FIG. 8 a perspective view of a height-adjustable bracket that supports all other parts of the fitting.

A mechanism for height adjustment of the fitting 22 will now be explained by reference to FIGS. 8 to 10 wherein, as parts of the fitting, only the axle tube 29 and the bracket 28 have been shown.

The axle tube 29 is a square tube on which a sleeve 50 is guided slidably but non-rotatably. The sleeve 50 is formed in one piece with the bracket 28 which may for example be a molded member made of plastic. The sleeve 50 has a square internal cross-section that matches the external cross-section of the axle tube 29. A cylindrical outer peripheral surface of the sleeve 50 forms a bearing for the carrier 24 which as not been shown here.

The bracket 28 is approximately L-shaped in plan view and has a bearing arm 52 on which the sleeve 50 is formed, and a control arm 54 in which the guide slot 38 is formed that is shaped as a swaying trench. A clamping lever 56 of which FIG. 8 shows only an actuating end 58 that projects beyond the control arm 54, is arranged on the bottom side of the bearing arm 52. The clamping lever 56 is pivotably supported on an axle pin 60 that extends between two opposite wall portions of a peripheral wall of the bracket 28 and of which FIG. 8 shows one end that projects out of the peripheral wall.

Figure 9:
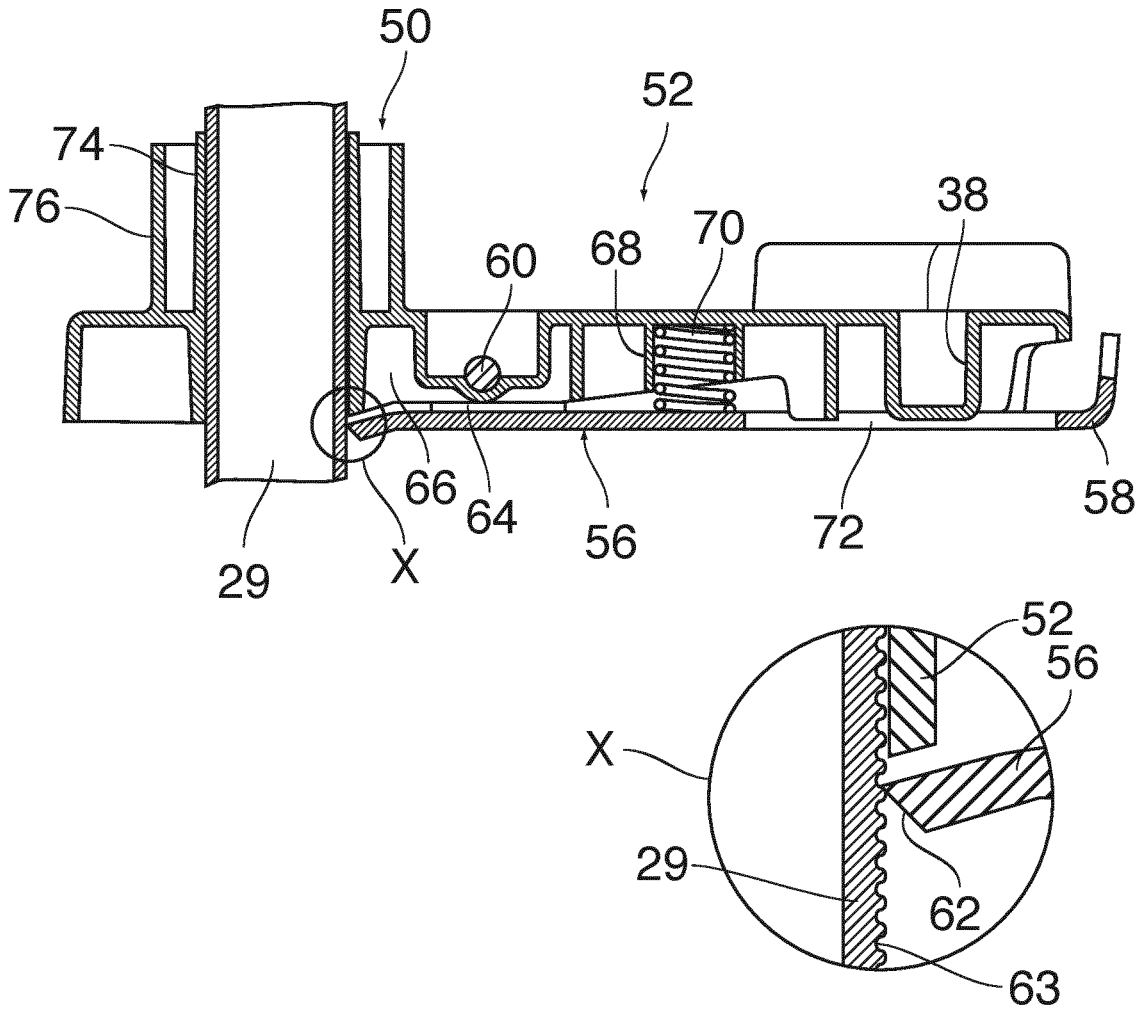
FIG. 9 a sectional view of the bracket and a clamping lever in its clamping position.
Figure 10:
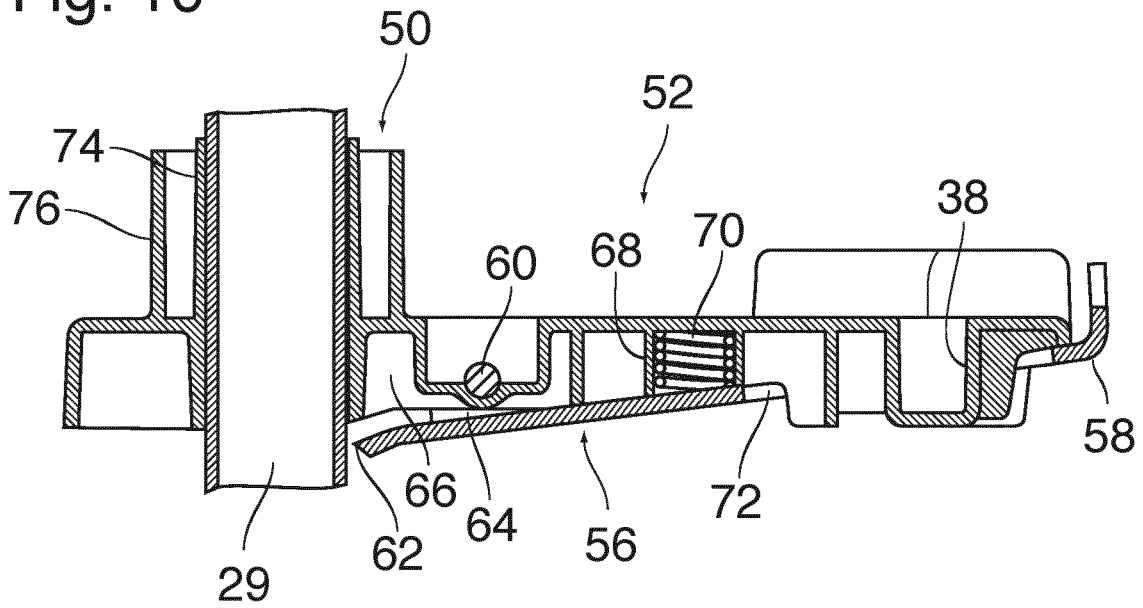
FIG. 10 the bracket and the clamping lever in a non-clamping position.

FIG. 9 shows a longitudinal section of the bearing arm 52 and the clamping lever 56. It can be seen that the clamping lever extends along the bottom side of the bracket towards the axle tube 29 and, there, forms an edge-like clamping contour 62 that engages a lateral face of the square axle tube 29 on its full width. This lateral surface has horizontal corrugations 63 as shown in an enlarged detail view X in FIG. 9. In the region of the axle pin 60, the clamping lever forms two tabs 64 projecting upwards from its front and rear edges in FIG. 9, with which the clamping lever is pivotably supported on the axle pin 60. In the drawing, only parts of the tabs 64 are visible because they are largely obscured by reinforcement ribs 66 of the bracket. However, on the side of the axle pin 60 facing away from the axle tube 29, the reinforcement ribs 66 form an upwardly slanting ramp that provides free space for pivoting the clamping lever 56. In the range of the ramp, a (helical) spring 70 is held in a spring seat 68, with one end of the spring being supported on an upper wall of the bracket and the other end being supported on the clamping lever 56, so that the clamping lever is biased clock-wise into the position shown in FIG. 9 in which the clamping contour 62 is held in engagement with the corrugations 63. Further outwards, the clamping lever 56 forms a recess 72 that exposes an area of the footprint of the clamping lever in which one end of the trench-like guide slot 38 is located.

The sleeve 50 has a double wall forming an inner wall 74 that defines the inner cross-section of the sleeve and, therewith, a guide contour for the axle tube 29, and a cylindrical outer wall 76 forming the bearing for the carrier 24. The inner wall 74 surrounds the axle tube 29 with little play. Because the clamping contour 62 of the clamping lever is supported on the axle tube 29, the bracket is subject to a force that causes the inner wall 74 of the sleeve 50 on the left side in FIG. 9 to smoothly engage the axle tube. In this condition, the bracket and the entire load supported on the bracket is therefore clampingly held on the axle tube 29. When the carrier 24 and the shelf have been mounted, the weight to thereof exerts a downward force onto the bracket. However, due to friction between the clamping contour 62 and the axle tube 29, an equal and oppositely directed force is created which prevents the bracket and the entire fitting from being lowered. Since the downloadly directed force is transmitted onto the clamping lever via the axle pin 60 whereas the upwardly directed force acts upon the clamping contour 62, a torque is created that has the tendency to pivot the clamping lever 56 further in clock-sense in FIG. 9, whereby the clamp action between the clamping contour 62 and the axle tube 29 is increased further. A download movement of the bracket 28 is then reliably prevented by the corrugations 63.

Further, it can be seen in FIG. 9 that the length of the lever arm between the axle pin 60 and the actuating end 58 of the clamping lever is significantly larger than the length of the lever arm formed between the axle pin 60 and the clamping contour 62. Even when the clamping lever 56 has been jammed relatively firmly into its clamping position it is therefore sufficient to exert by hand a relatively small upwardly directed force onto the actuating end 58 in order to pivot the clamping lever into the released position shown in FIG. 10 in which the clamping contour 62 releases the axle tube 29. At the same time, the upwardly directed force that is exerted by hand onto the actuating end prevents the fitting from sliding downwards along the axle tube 29. Then, the bracket can controllably be moved into the desired height. As soon as the user releases the actuating end 58, the spring 70 assures that the clamping lever returns into the clamping position and locks the fitting in the position that has been reached.

When the fitting is initially installed in the corner cabinet, the height of the bracket 28 can conveniently be adjusted before the carrier 24 and the shelf are mounted on the bracket.

The axle tube 29 may be extendable telescopically in its upper end portion, so that a spacing may temporarily be formed between the top end of the axle tube and the top wall of the cabinet body, which makes it possible to push the carrier 24 onto the axle tube from above until it is supported on the sleeve 50.

If the height of the shelf is to be adjusted afterwards, the fitting may temporarily be moved into the drawn-out position shown in FIG. 7, where the shelf 20 can be detached from the pull-out guide in order to provide easy access to the clamping lever 56. The carrier 24 is then in a position in which the actuating end 58 of the clamping lever can be clasped by hand in order to perform the height adjustment.

What is claimed is:

1. A pivot and pull-out fitting for supporting a shelf in a corner cabinet, comprising:

a carrier configured to be held rotatably about a vertical axis in the corner cabinet;

a pivot bearing for pivotably mounting the shelf on the carrier;

a pull-out guide, on which the shelf can be displaced relative to the carrier;

an axle tube configured to be rigidly installed in the corner cabinet;

a clamping lever; and a bracket guided in a rotationally fixed and axial displaceable manner on the axle tube, and adapted to be secured in a self-locking manner on the axle tube by the clamping lever;

wherein the carrier is mounted pivotably on the bracket.

2. The fitting according to claim 1, wherein the clamping lever is pivotable about a horizontal axis and is arranged on a bottom side of the bracket.

3. The fitting according to claim 1, wherein the axle tube is a square tube and the clamping lever has a straight clamping contour that engages a lateral face of the axle tube on its entire width.

4. The fitting according to claim 1, wherein the clamping lever is elastically biased into its clamping position.

5. The fitting according to claim 1, wherein the clamping lever has an actuating end that projects beyond the contour of the bracket and, relative to the axis of the clamping lever, forms a first lever arm portion that is longer than a second lever arm portion between the axis and an opposite end of the clamping lever that engages the axle tube.

6. The fitting according to claim 1, wherein the axle tube has corrugations for engagement with the clamping lever.

* * * * *